US011384908B2

(12) United States Patent
Chen et al.

(10) Patent No.: US 11,384,908 B2
(45) Date of Patent: Jul. 12, 2022

(54) ANTI-GLARE DOWNLIGHT APPARATUS

(71) Applicant: XIAMEN LEEDARSON LIGHTING CO., LTD, Fujian (CN)

(72) Inventors: Yizhen Chen, Fujian (CN); Yongzhe Dong, Fujian (CN); Shuxing Gao, Fujian (CN); Zhenyu Tang, Fujian (CN)

(73) Assignee: XIAMEN LEEDARSON LIGHTING CO., LTD, Fujian (CN)

( * ) Notice: Subject to any disclaimer, the term of this patent is extended or adjusted under 35 U.S.C. 154(b) by 0 days.

(21) Appl. No.: 16/985,984

(22) Filed: Aug. 5, 2020

(65) Prior Publication Data

US 2021/0372579 A1 Dec. 2, 2021

(30) Foreign Application Priority Data

May 27, 2020 (CN) ..... 202020959417.1

(51) Int. Cl.

| | |
|---|---|
| ***F21S 8/02*** | (2006.01) |
| ***F21K 9/20*** | (2016.01) |
| ***F21K 9/69*** | (2016.01) |
| ***F21V 31/00*** | (2006.01) |
| ***F21V 21/04*** | (2006.01) |
| ***F21V 23/00*** | (2015.01) |
| ***F21V 3/04*** | (2018.01) |
| ***F21V 9/08*** | (2018.01) |
| ***F21V 3/10*** | (2018.01) |

(52) U.S. Cl.

CPC *F21S 8/02* (2013.01); *F21K 9/20* (2016.08); *F21K 9/69* (2016.08); *F21V 3/04* (2013.01); *F21V 3/10* (2018.02); *F21V 9/08* (2013.01); *F21V 21/04* (2013.01); *F21V 23/006* (2013.01); *F21V 31/005* (2013.01)

(58) Field of Classification Search

CPC .... F21S 8/02; F21S 8/026; F21V 3/10; F21V 9/08; F21V 21/04

See application file for complete search history.

(56) References Cited

U.S. PATENT DOCUMENTS

| | | | | |
|---|---|---|---|---|
| 5,707,143 | A * | 1/1998 | Hentz | F21S 8/02 362/147 |
| 6,364,511 | B1 * | 4/2002 | Cohen | F21S 8/02 362/148 |
| 2013/0010476 | A1 * | 1/2013 | Pickard | F21V 13/14 362/311.03 |
| 2017/0191641 | A1 * | 7/2017 | Harpenau | F21V 17/12 |
| 2019/0376664 | A1 * | 12/2019 | Ragazzi | F21V 9/40 |

* cited by examiner

*Primary Examiner* — William N Harris
(74) *Attorney, Agent, or Firm* — Chun-Ming Shih; Lanway IPR Services

(57) ABSTRACT

An anti-glare downlight apparatus includes a rim housing, an anti-glare cup and a light source module. The rim housing has an installation space. The anti-glare cup has an installation part and a light passing hole. The anti-glare hole is enclosed by the installation space. The light source module has a LED module and a mounting bracket. The mounting bracket is attached to the installation part of the anti-glare cup for a light emitted from the LED module passing through the light passing hole of the anti-glare cup. The anti-glare cup has an inner wall with a light absorbing layer for absorbing a portion of the light.

17 Claims, 8 Drawing Sheets

ANTI-GLARE DOWNLIGHT APPARATUS

FIELD

The present application is related to a lighting apparatus and more particularly related to an LED lighting apparatus.

BACKGROUND

The time when the darkness is being lighten up by the light, human have noticed the need of lighting up this planet. Light has become one of the necessities we live with through the day and the night. During the darkness after sunset, there is no natural light, and human have been finding ways to light up the darkness with artificial light. From a torch, candles to the light we have nowadays, the use of light have been changed through decades and the development of lighting continues on.

Early human found the control of fire which is a turning point of the human history. Fire provides light to bright up the darkness that have allowed human activities to continue into the darker and colder hour of the hour after sunset. Fire gives human beings the first form of light and heat to cook food, make tools, have heat to live through cold winter and lighting to see in the dark.

Lighting is now not to be limited just for providing the light we need, but it is also for setting up the mood and atmosphere being created for an area. Proper lighting for an area needs a good combination of daylight conditions and artificial lights. There are many ways to improve lighting in a better cost and energy saving. LED lighting, a solid-state lamp that uses light-emitting diodes as the source of light, is a solution when it comes to energy-efficient lighting. LED lighting provides lower cost, energy saving and longer life span.

The major use of the light emitting diodes is for illumination. The light emitting diodes is recently used in light bulb, light strip or light tube for a longer lifetime and a lower energy consumption of the light. The light emitting diodes shows a new type of illumination which brings more convenience to our lives. Nowadays, light emitting diode light may be often seen in the market with various forms and affordable prices.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

In 1878, Thomas Edison tried to make a usable light bulb after experimenting different materials. In November 1879, Edison filed a patent for an electric lamp with a carbon filament and keep testing to find the perfect filament for his light bulb. The highest melting point of any chemical element, tungsten, was known by Edison to be an excellent material for light bulb filaments, but the machinery needed to produce super-fine tungsten wire was not available in the late 19th century. Tungsten is still the primary material used in incandescent bulb filaments today.

Early candles were made in China in about 200 BC from whale fat and rice paper wick. They were made from other materials through time, like tallow, spermaceti, colza oil and beeswax until the discovery of paraffin wax which made production of candles cheap and affordable to everyone.

Wick was also improved over time that made from paper, cotton, hemp and flax with different times and ways of burning. Although not a major light source now, candles are still here as decorative items and a light source in emergency situations. They are used for celebrations such as birthdays, religious rituals, for making atmosphere and as a decor.

Illumination has been improved throughout the times. Even now, the lighting device we used today are still being improved. From the illumination of the sun to the time when human can control fire for providing illumination which changed human history, we have been improving the lighting source for a better efficiency and sense. From the invention of candle, gas lamp, electric carbon arc lamp, kerosene lamp, light bulb, fluorescent lamp to LED lamp, the improvement of illumination shows the necessity of light in human lives.

Setting is always an important feature for a lighting apparatus. When lighting devices provide more functions, it is difficult to provide a convenient setting interface which has low cost, and reliable. Therefore, it is important to provide a flexible design on setting a parameter for various lighting devices.

In addition to setting, people dislike light directly emitted into their eyes. This issue is particularly important in environment people easily see the light source.

For example, in an office with large area, even downlight devices are installed in holes of the ceiling, its light is still making people under the ceiling uncomfortable. It is therefore beneficial to design a light device solving such problems.

SUMMARY

In some embodiments, an anti-glare downlight apparatus includes a rim housing, an anti-glare cup and a light source module.

The rim housing has an installation space. The anti-glare cup has an installation part and a light passing hole. The anti-glare hole is enclosed by the installation space.

The light source module has a LED module and a mounting bracket. The mounting bracket is attached to the installation part of the anti-glare cup for a light emitted from the LED module passing through the light passing hole of the anti-glare cup. The anti-glare cup has an inner wall with a light absorbing layer for absorbing a portion of the light.

In some embodiments, the inner wall of the anti-glare cup has a first end and a second end on opposite sides of the light passing hole. The first end is closer to the LED module than the second end. A first diameter of the first end is smaller than a second diameter of the second end.

In some embodiments, the anti-glare has an external wall connected to the inner wall of the anti-glare cup at the second end. There is an enlarging gap between the external wall and the inner wall from the second end to the first end.

In some embodiments, the external wall is parallel with a lateral wall of the rim housing.

In some embodiments, the rim housing has a surface rim fixed to the lateral wall of the rim housing.

In some embodiments, the lateral wall has more than 50% portion kept perpendicular to the surface rim.

In some embodiments, there are multiple circular ring convex structures arranged in parallel on a surface of the inner wall.

In some embodiments, the light absorbing layer has a light absorbing color

In some embodiments, the light absorbing color is a darken color.

In some embodiments, the installation part of the anti-glare cup is attached to a housing bottom of the rim housing.

In some embodiments, the installation part of the anti-glare cup and the housing bottom are buckled to be fixed.

In some embodiments, the light source has a lens for converting the light of the LED module to become a light beam passing through the light passing hole.

In some embodiments, a peripheral edge of the lens presses a border of the anti-glare cup forming a sealing structure preventing water passing through the light passing hole to engage the LED module.

In some embodiments, the anti-glare cup has an assembling convex border engaging the peripheral edge of the lens.

In some embodiments, the anti-glare downlight apparatus may also include a driver module converting an external power to a driving current supplying to the LED module.

In some embodiments, the driver module includes a driver board and a driver circuit, the driver circuit is disposed on the driver board, the driver board is disposed around the light source module.

In some embodiments, the driver board is disposed surrounding the light source module.

In some embodiments, the driver circuit is disposed at an overlapping height position as the lens.

In some embodiments, there is a back cover is fixed to a housing bottom clipping multiple installation elastic clips for fixing the anti-glare downlight apparatus to an installation platform.

In some embodiments, the anti-glare downlight apparatus may also include an isolation piece attached to the installation part forming an isolation space containing a driver module and the light source module.

DETAILED DESCRIPTION

Figure 3:
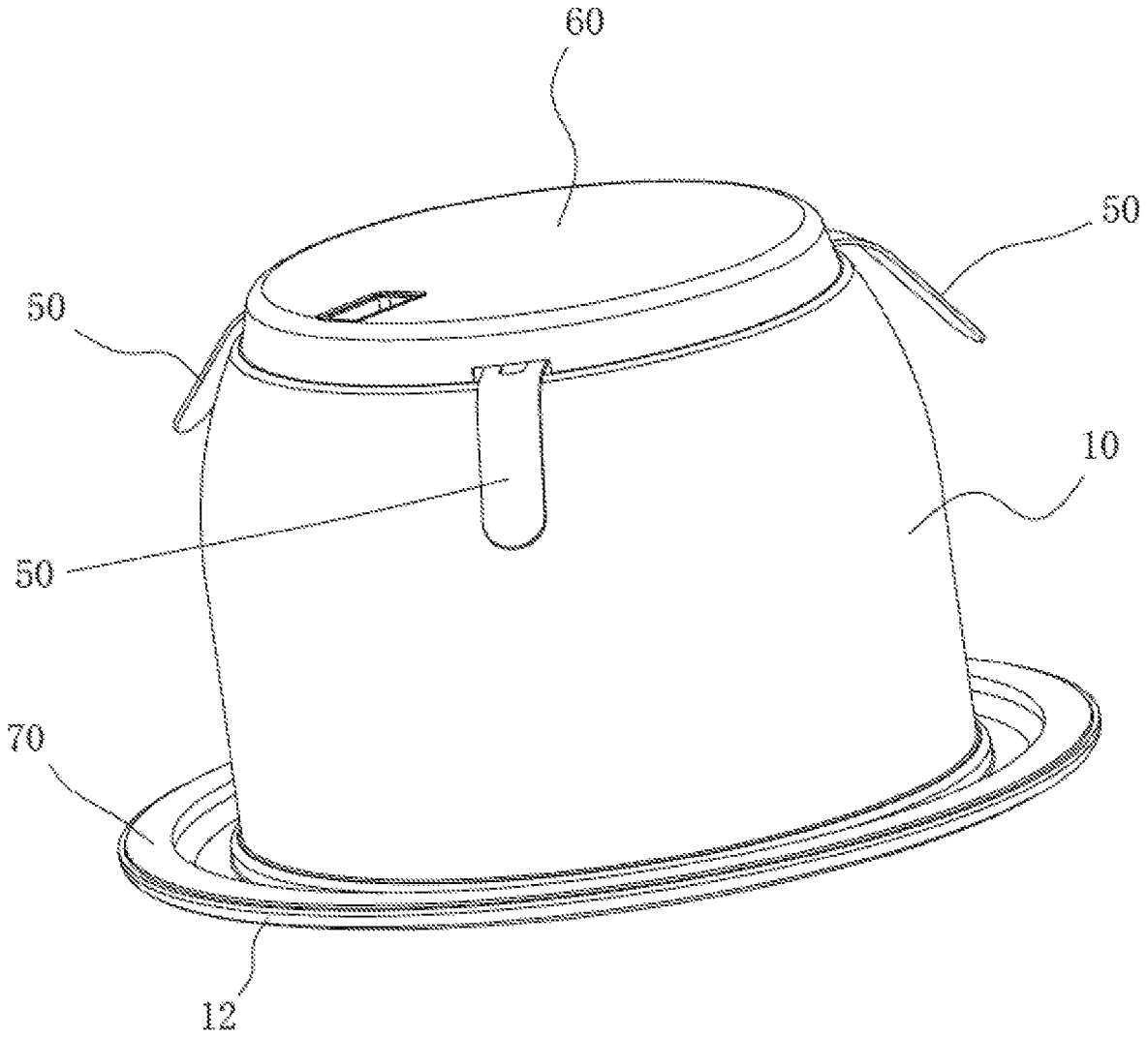
FIG. 3 shows another view of the embodiment.
Figure 4:
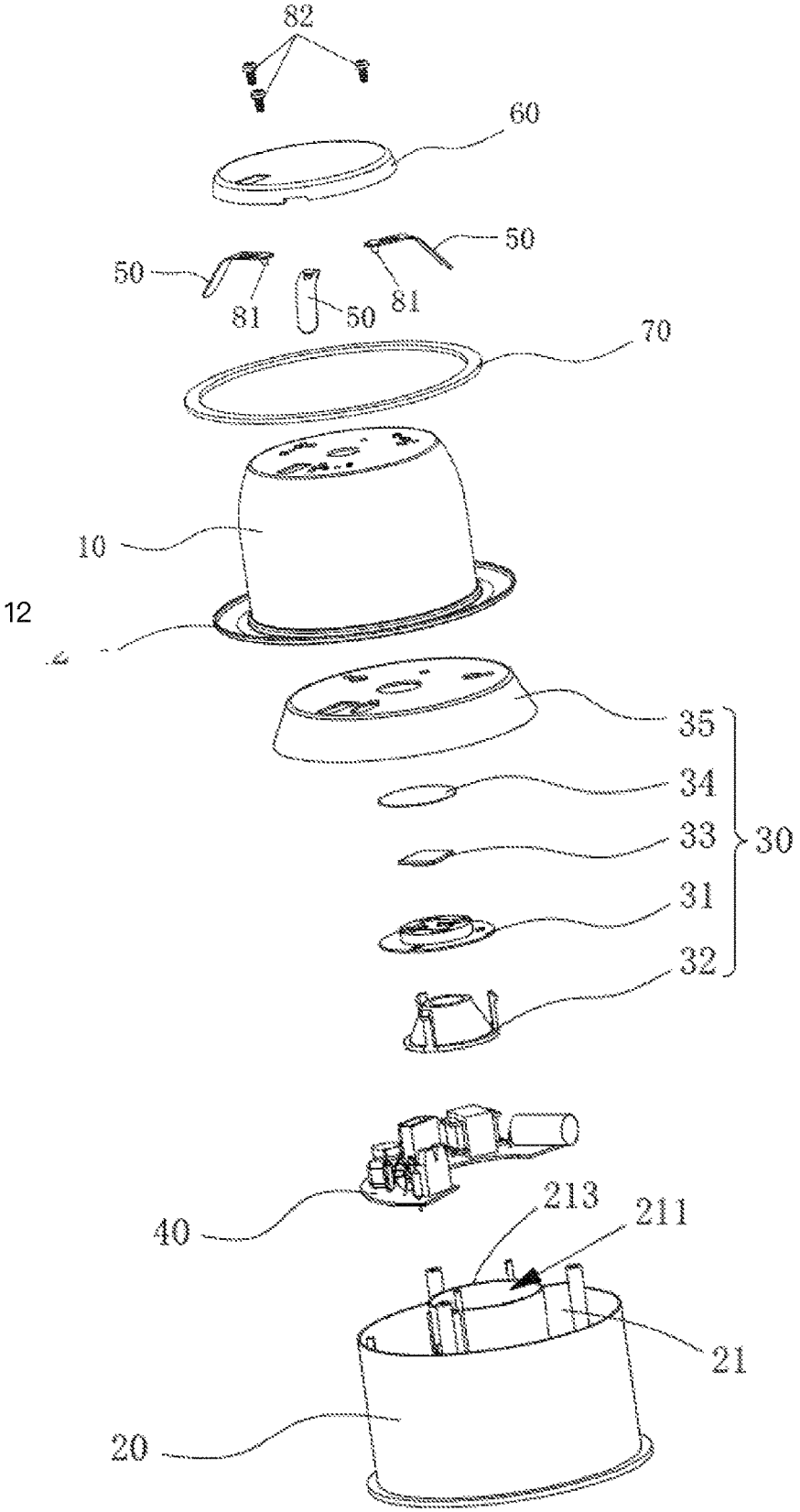
FIG. 4 shows another view of the embodiment in an exploded view.
Figure 8:
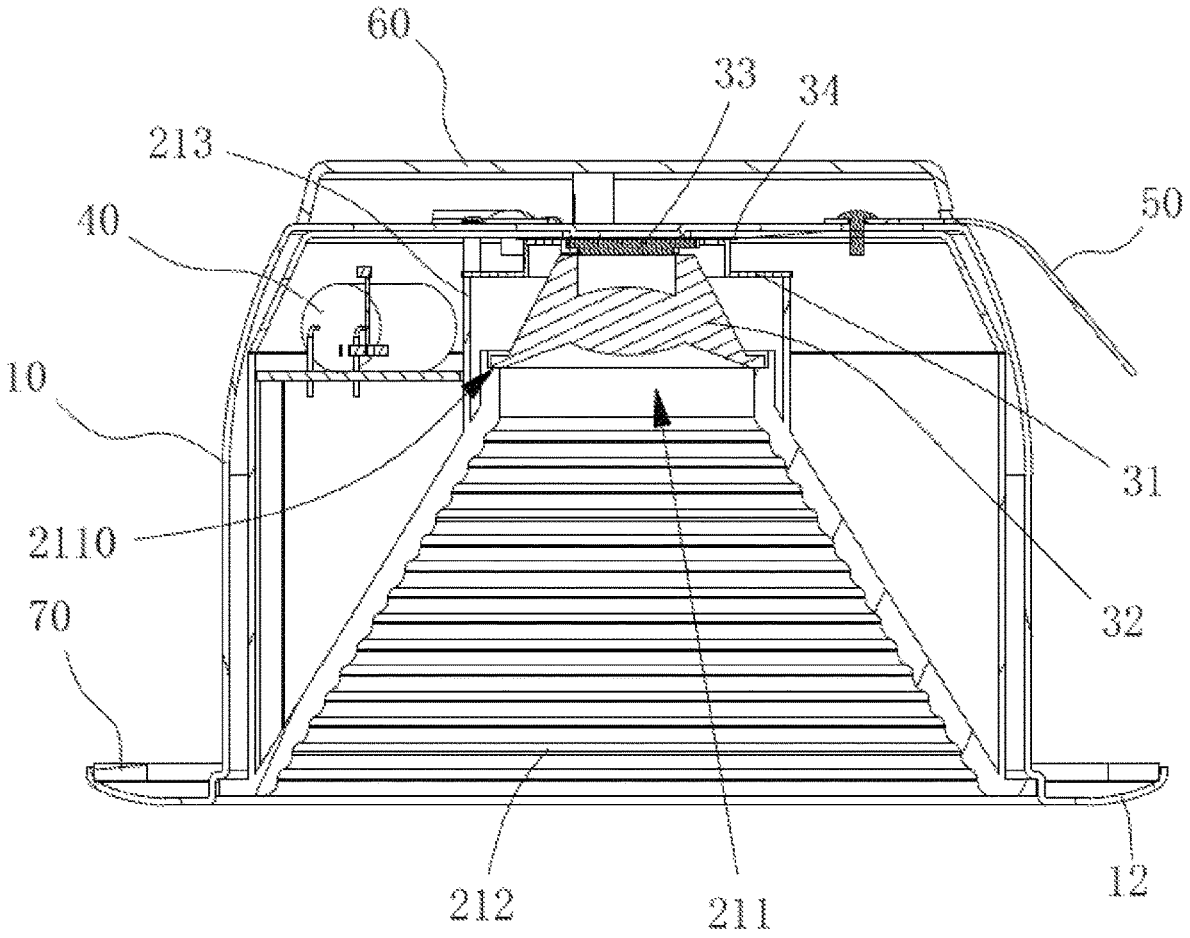
FIG. 8 shows a cross section view of the embodiment.

Please refer to FIG. 3, FIG. 4 and FIG. 8. In FIG. 3, FIG. 4 and FIG. 8, an anti-glare downlight apparatus includes a rim housing 10, an anti-glare cup 20 and a light source module 30.

The rim housing 10 has an installation space 11. The anti-glare cup 20 has an installation part 21 and a light passing hole 211. The anti-glare cup 20 is enclosed by the installation space 11.

The light source module 30 has a LED module 33 and a mounting bracket 31. The mounting bracket 31 is attached to the LED module 33 for aligning a light emitted from the LED module passing through the light passing hole of the anti-glare cup. The anti-glare cup has an inner wall with a light absorbing layer for absorbing a portion of the light.

In some embodiments, the inner wall of the anti-glare cup 20 has a first end and a second end on opposite sides of the light passing hole. The first end is closer to the LED module 33 than the second end 2193. A first diameter of the first end is smaller than a second diameter of the second end.

In some embodiments, the anti-glare has an external wall connected to the inner wall of the anti-glare cup 20 at the second end. There is an enlarging gap between the external wall and the inner wall from the second end 2193 to the first end.

In some embodiments, the external wall is parallel with a lateral wall of the rim housing 10.

In some embodiments, the rim housing 10 has a surface rim 12 fixed to the lateral wall of the rim housing 10.

In some embodiments, the lateral wall has more than 50% portion kept perpendicular to the surface rim 12.

In some embodiments, there are multiple circular ring convex structures 212 arranged in parallel on a surface of the inner wall.

In some embodiments, the light absorbing layer has a light absorbing color.

In some embodiments, the light absorbing color is a darken color, e.g. black color.

In some embodiments, the installation part 21 of the anti-glare cup 20 is attached to a housing bottom of the rim housing 10.

In some embodiments, the installation part 21 of the anti-glare cup 20 and the housing bottom are buckled to be fixed. For example, a buckle hook and a buckle hole are respectively disposed on the anti-glare cup 20 and the housing bottom for providing a buckle connection, to save the cost for screws and increase convenience for assembling.

In FIG. 8, the light source has a lens 32 for converting the light of the LED module 33 to become a light beam passing through the light passing hole 211.

In some embodiments, a peripheral edge of the lens 32 presses a border of the anti-glare cup forming a sealing structure preventing water passing through the light passing hole to engage the LED module.

In some embodiments, the anti-glare cup has an assembling convex border 2110, an example of the border mentioned above, engaging the peripheral edge of the lens 32.

In some embodiments, the anti-glare downlight apparatus may also include a driver module 40 converting an external power to a driving current supplying to the LED module 32. For example, the driver module has a rectifier, a filter and a transformer (not shown in the drawing) for converting a 110V/220V alternating current source to a direct current source as a driving current supplied to the LED module.

The driver module 40 may also include wireless circuits for receiving an external command on controlling the LED module, e.g. to mix a desired color temperature or adjusting intensity. Antenna is necessary for such wireless circuit and may be disposed on the anti-glare cup, e.g. the ring convex structures 212 for better signal quality. In such case, there is a contact electrode for connecting the antenna to the wireless circuit of the driver module 40.

In some embodiments, the driver module 40 includes a driver board and a driver circuit. The driver circuit is disposed on the driver board. The driver board is disposed around the light source module 32. In some embodiments, the driver board may be a ring shape or a curve shape for completely or partially surrounding the light source module 30.

In some embodiments, the driver board is disposed surrounding the light source module 30.

In some embodiments, the driver circuit is disposed at an overlapping height position as the lens 32, like the arrangement illustrated in FIG. 8.

In some embodiments, there is a back cover 60 is fixed to a housing bottom clipping multiple installation elastic clips 50 for fixing the anti-glare downlight apparatus to an installation platform, like a ceiling or a wall.

In FIG. 4, the anti-glare downlight apparatus may also include an isolation piece 35 attached to the installation part 21 forming an isolation space containing a driver module 40 and other components of the light source module 30.

Some details are further described below in addition to the description above.

Figure 1:
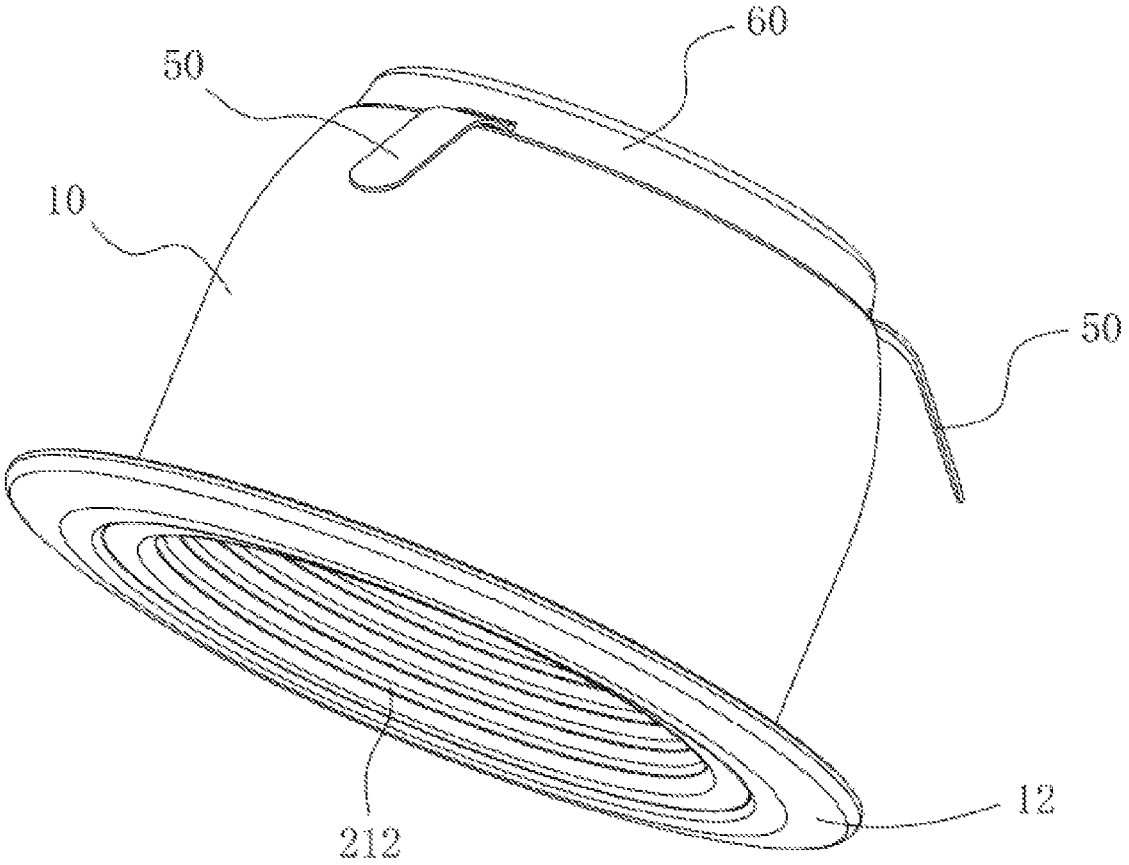
FIG. 1 shows an embodiment of a downlight apparatus.

First, FIG. 1 shows an embodiment of an anti-glare downlight apparatus. Reference numerals mentioned above refer to the same components and are not repeated for brevity.

Figure 2:
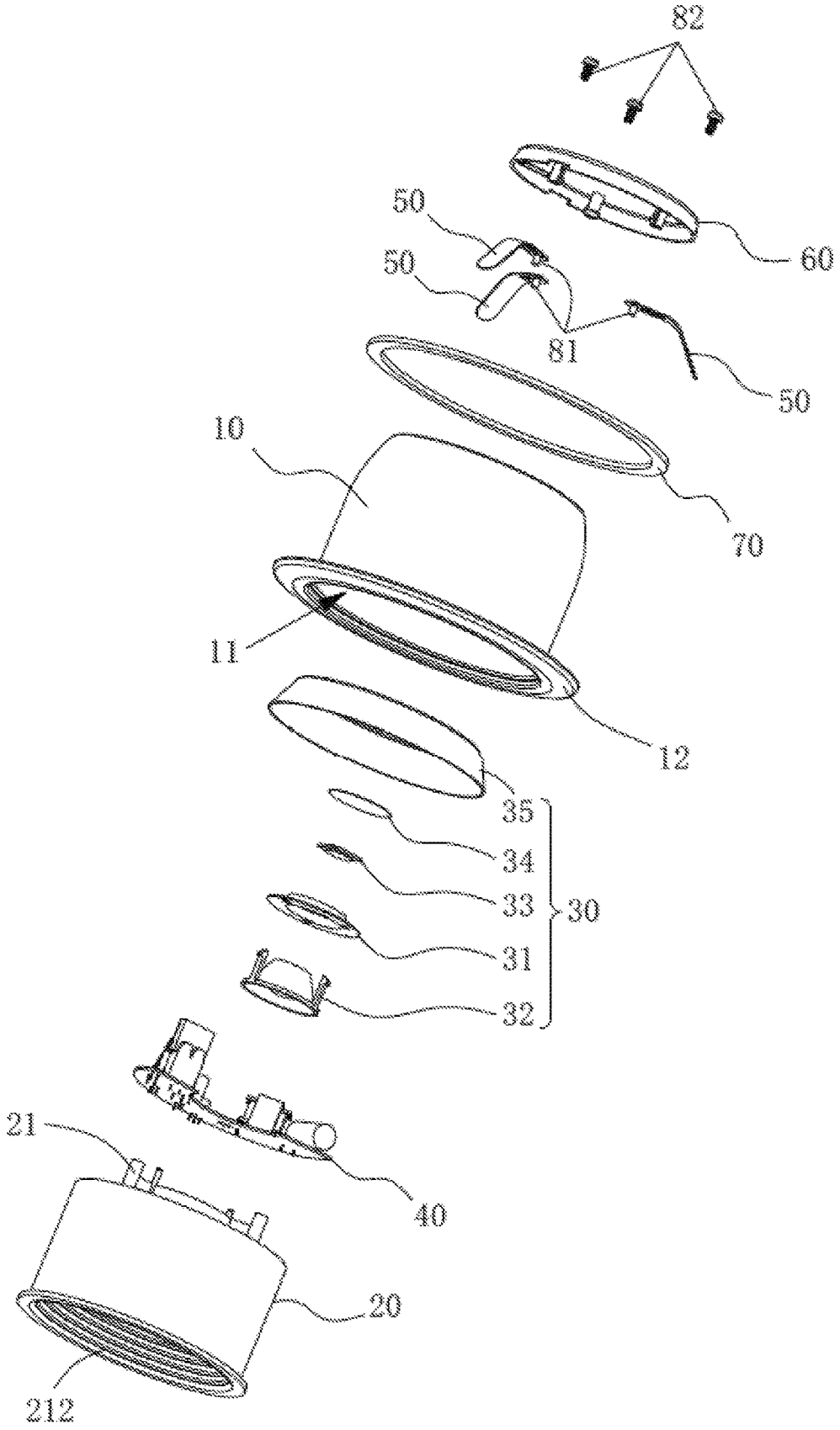
FIG. 2 shows an exploded view of the downlight apparatus.

FIG. 2 shows an exploded view of an embodiment. In addition to the description mentioned above, the three installation elastic clips 50 have screw holes for passing the screws 82 to be fixed between the back cover 60 and the rim housing 10. There is a water proof ring 70 disposed for preventing water passing via the surface rim, e.g. water from a bathroom or other wet environment.

There is a heat dissipation pad 34 for performing heat dissipation. The lens 32 has side hooks for fixing to other components.

FIG. 3 shows another view of the embodiment.

FIG. 4 shows another view of the embodiment in an exploded view.

Figure 5:
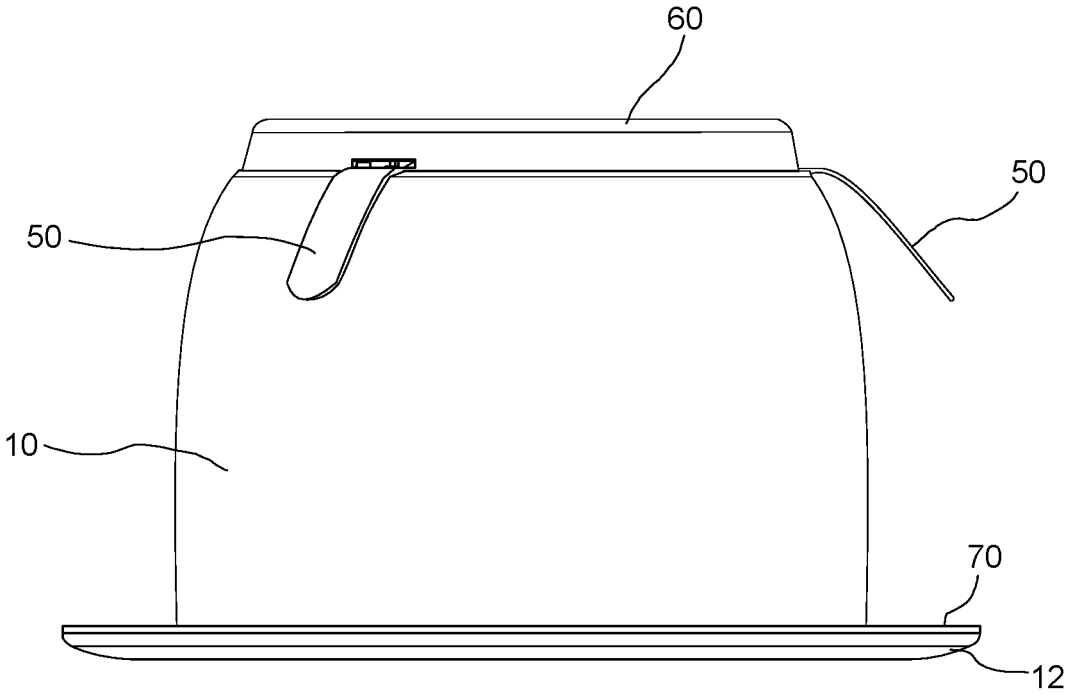
FIG. 5 is a side view of the embodiment.

FIG. 5 is a side view of the embodiment.

Figure 6:
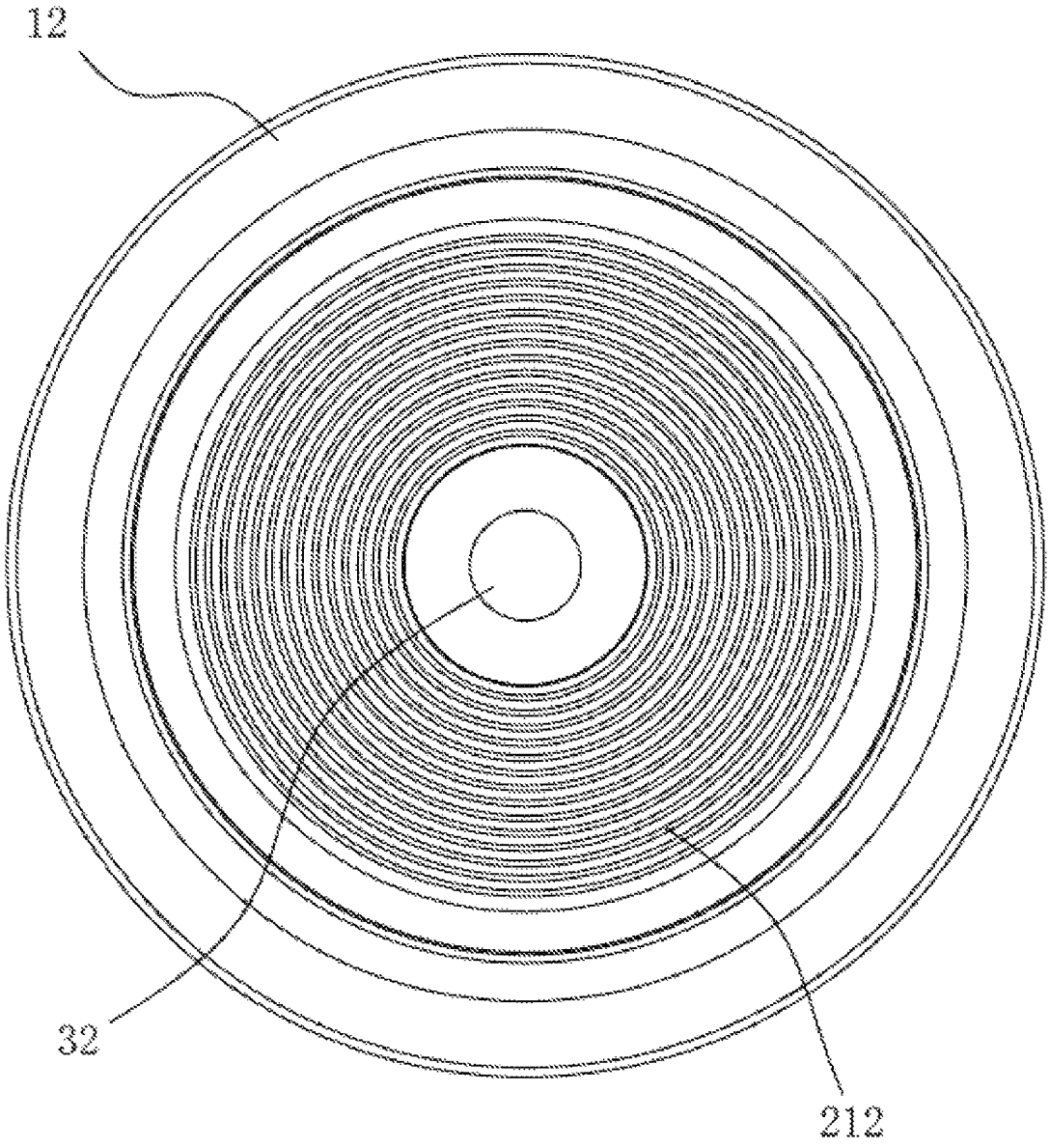
FIG. 6 provides a bottom view of the embodiment to see the anti-glare cup.

FIG. 6 provides a bottom view of the embodiment to see the anti-glare cup.

Figure 7:
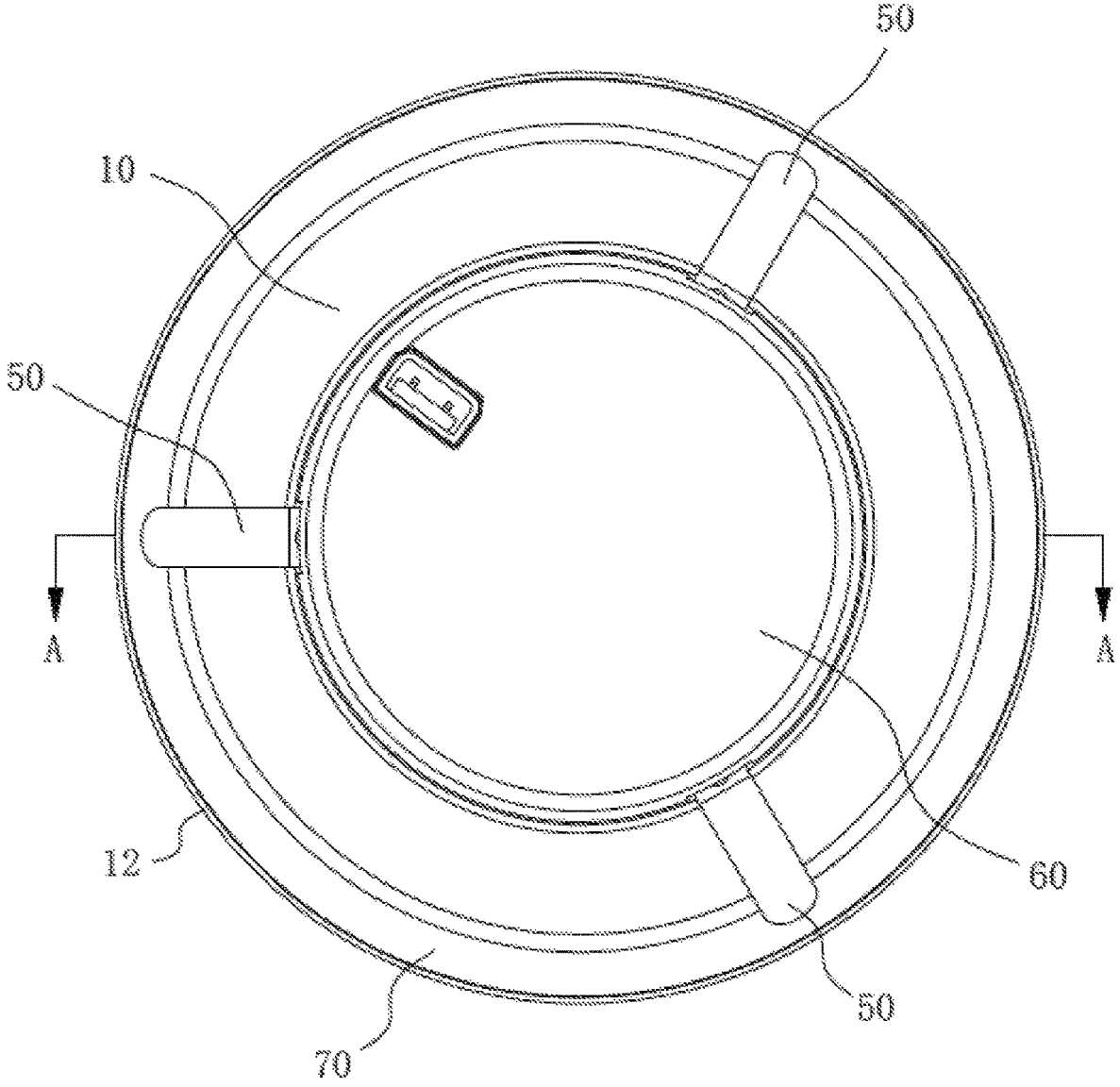
FIG. 7 provides a top view of the embodiment.

FIG. 7 provides a top view of the embodiment.

FIG. 8 shows a cross section view of the embodiment. The mounting bracket 213 is used for connecting components and align components.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. An anti-glare downlight apparatus, comprising:

a rim housing having an installation space;

an anti-glare cup having an installation part and a light passing hole, the anti-glare cup being enclosed by the installation space;

a light source module having a LED module and a mounting bracket, the mounting bracket being attached to the LED module for aligning a light emitted from the LED module passing through the light passing hole of the anti-glare cup, the anti-glare cup having an inner wall with a light absorbing layer for absorbing a portion of the light; and a driver module converting an external power to a driving current supplying to the LED module, wherein the driver module comprises a driver board and a driver circuit, wherein the driver circuit is disposed at a height which is the same as that of the lens.

2. The anti-glare downlight apparatus of claim 1, wherein the inner wall of the anti-glare cup has a first end and a second end on opposite sides of the light passing hole, the first end is closer to the LED module than the second end and a first diameter of the first end is smaller than a second diameter of the second end.

3. The anti-glare downlight apparatus of claim 2, wherein the anti-glare cup has an external wall connected to the inner wall of the anti-glare cup at the second end, there is an enlarging gap between the external wall and the inner wall from the second end to the first end.

4. The anti-glare downlight apparatus of claim 3, wherein the external wall is parallel with a lateral wall of the rim housing.

5. The anti-glare downlight apparatus of claim 3, wherein the rim housing has a surface rim fixed to the lateral wall of the rim housing.

6. The anti-glare downlight apparatus of claim 3, wherein more than 50% of the lateral wall is kept perpendicular to the surface rim.

7. The anti-glare downlight apparatus of claim 2, wherein there are multiple circular ring convex structures arranged in parallel on a surface of the inner wall.

8. The anti-glare downlight apparatus of claim 2, wherein the light absorbing layer has a light absorbing color.

9. The anti-glare downlight apparatus of claim 8, wherein the light absorbing color is a dark color.

10. The anti-glare downlight apparatus of claim 1, wherein the installation part of the anti-glare cup is attached to a housing bottom of the rim housing.

11. The anti-glare downlight apparatus of claim 10, wherein the installation part of the anti-glare cup and the housing bottom are buckled to be fixed.

12. The anti-glare downlight apparatus of claim 1, wherein the light source has a lens for converting the light of the LED module to become a light beam passing through the light passing hole.

13. The anti-glare downlight apparatus of claim 12, wherein a peripheral edge of the lens presses a border of the anti-glare cup forming a sealing structure preventing water passing through the light passing hole to engage the LED module.

14. The anti-glare downlight apparatus of claim 13, wherein the anti-glare cup has an assembling convex border engaging the peripheral edge of the lens.

15. The anti-glare downlight apparatus of claim 1, wherein the driver circuit is disposed on the driver board, the driver board is disposed around the light source module.

16. The anti-glare downlight apparatus of claim 1, wherein a back cover is fixed to a housing bottom clipping multiple installation elastic clips for fixing the anti-glare downlight apparatus to an installation platform.

17. The anti-glare downlight apparatus of claim 1, further comprising an isolation piece attached to the installation part forming an isolation space containing a driver module and the light source module.

* * * * *